United States Patent [19]

Hardesty

[11] 4,002,392

[45] Jan. 11, 1977

[54] ELECTRICAL CONNECTING DEVICES FOR TERMINATING CORDS

[75] Inventor: Edwin Charles Hardesty, Perry Hall, Md.

[73] Assignee: Western Electric Company, Inc., New York, N.Y.

[22] Filed: Oct. 6, 1975

[21] Appl. No.: 620,630

Related U.S. Application Data

[63] Continuation-in-part of Ser. No. 521,429, Nov. 6, 1974, Pat. No. 3,954,320, which is a continuation-in-part of Ser. No. 377,154, July 6, 1973, Pat. No. 3,860,316.

[52] U.S. Cl. ..... 339/99 R; 339/103 R

[51] Int. Cl.[2] ..... H01R 13/38; H01R 13/58

[58] Field of Search ..... 339/95, 97–99, 339/101, 103

[56] References Cited

UNITED STATES PATENTS 3,860,316 1/1975 Hardesty ..... 339/99 R

*Primary Examiner*—Joseph H. McGlynn
*Attorney, Agent, or Firm*—E. W. Somers

[57] ABSTRACT

A cord terminating plug includes an unipartite, non-hinged, dielectric housing with a free end and a cord input end which opens to a cavity and with provisions for preventing ingress of moisture and other contaminants. A cord jacket anchoring member disposed within a well is formed integrally of the housing through a connecting hinge oriented toward the free end and a frangible portion oriented inward the cord-input end. The anchoring member has two intersecting externally facing surfaces with one of the surfaces having a stop formed thereon. Forces are applied to the anchoring member to disconnect it from the housing through the frangible portion and move it pivotally into clamping engagement with the cord jacket. A portion of the anchoring member adjacent the intersection of the externally facing surfaces is compressed and then reformed with the stop engaging a wall which defines the well and with portions of the one surface engaging an inwardly facing surface of the cavity adjacent the cord-input end of the housing, the dual engagement of the stop and the one surface with the housing maintaining the anchoring member in locked engagement with the cord. Another portion formed integrally with the housing is reformed to provide strain relief for the cord conductors. Terminals inserted into the dielectric housing engage with the conductors and have external contacting portions positioned for engagement with associated components of a telephone apparatus when the plug is inserted thereinto.

21 Claims, 14 Drawing Figures

ELECTRICAL CONNECTING DEVICES FOR TERMINATING CORDS

CROSS REFERENCE TO RELATED APPLICATIONS

This is a continuation-in-part of my copending application, Ser. No. 521,429 filed Nov. 6, 1974, U.S. Pat. No. 3,954,320, which is a continuation-in-part of my application, Ser. No. 377,154 filed July 6, 1973, now U.S. Pat. No. 3,860,316.

BACKGROUND OF THE INVENTION

1. Field of the Invention

This invention relates to electrical connecting devices for terminating cords, and more particularly, to devices for making electrical connections between cord conductors and terminals which includes cord strain-relief facilities that are maintained in locked engagement with the cord and a housing of the device during, for example, the application of retrograde forces to the cord during use by the customer.

2. Description of the Prior Art

In the telephone industry, increasing use is being made of modular plug type connectors on retractile handset and on straight line cords which are used between the telephone base and a wall terminal block. In the presently used plugs, a terminal is applied to each of a plurality of insulated conductors contained within a jacketed length of a retractile cordage. These terminals are mounted within a dielectric structure which is attached securely to the associated cordage. The dielectric portions of the plugs, which are mounted on both ends of a length of a cordage, cooperate with receptacles in the wall terminal block and in the telephone base to properly align the terminals of the plug with associated terminals within the wall block and the telephone.

In one plug disclosed in U.S. Pat. No. 3,699,498 issued on Oct. 17, 1972 in the names of E. C. Hardesty, C. L. Krumreich, A. E. Mulbarger, Jr. and S. W. Walden, conductors are confined in conductor-receiving troughs formed in a dielectric base by a cover bonded to the base with flat terminals inserted into individual grooves in the base in a side-by-side arrangement with contact portions thereof extending into engagement with the conductors. See also U.S. Pat. No. 3,761,869 issued Sept. 25, 1973 in the names of E. C. Hardesty, C. L. Krumreich, A. E. Mulbarger, Jr. and S. W. Walden.

It would be desirable both from the ease and the cost of manufacturing to construct a one-piece plug, into which a telephone cord end may be inserted and secured and subsequently engaged by terminals moved into terminal-receiving openings in the plug. Such a plug would require jacket and conductor strain-relief facilities which desirably could be moved, subsequent to insertion of a cord end portion, into a locked position to effectively and continuously resist retrograde forces applied to the cord.

SUMMARY OF THE INVENTION

This invention provides electrical connecting devices for terminating cords with excellent cord strain-relief facilities. A dielectric portion of the device can be fabricated in one piece by using conventional molding techniques. The device may be assembled to a line cord, or to a retractile cord either before or after the cord is heat treated to achieve retractile properties.

An electrical connecting device which embodies the principles of this invention is molded to include a one-piece or unipartite dielectric housing having a free end and which also includes a cavity that opens to a cord-input end of the housing for receiving an end section of a telephone cord. Unipartite or one piece as used to describe the housing is intended to define the housing as not divided or divisible into parts. Moreover, the housing is molded so that no securing, including bonding, nor moving of hinged or otherwise moveable parts is necessary to form the initial configuration of the housing. The surfaces of the housing as molded define the cavity and substantially enclose the end portion of the cord. The housing is formed with at least one portion adjacent the cavity being disposed within a well, which communicates with the cavity and is connected pivotally to the remainder of the housing toward the free end thereof and having two intersecting externally facing surfaces with one of the surfaces having a stop formed thereon. The pivotally connected portion is capable of being moved from the initial position to an actuated position at least partially into the cavity engaging and clamping portions of the cord, and with a portion of the pivotally moveable portion adjacent the intersection of the externally facing surfaces being deformed temporarily and then reforming with a portion of the one surface engaging a portion of an inwardly facing surface of the cavity adjacent the cord-input end of the housing and with the stop engaging a surface, which defines the well and which adjoins the inwardly facing surface of the cavity. The dual engagement of portions of the one surface and of the stop causes a locking relationship of the pivotally moveable portion with the cord and with the remainder of the housing which is maintained during the application of retrograde forces to the cord. A plurality of electrically conductive terminals are positioned within the housing and extend between the cavity for piercing the insulation of and making electrical engagement with associated conductors of the cord and an external surface for making electrical contact external to the connector.

BRIEF DESCRIPTION OF THE DRAWINGS

Other features of the present invention will be readily understood from the following detailed description of specific embodiments thereof when read in conjunction with the accompanying drawings, in which.

DETAILED DESCRIPTION

Overall

Figure 1:
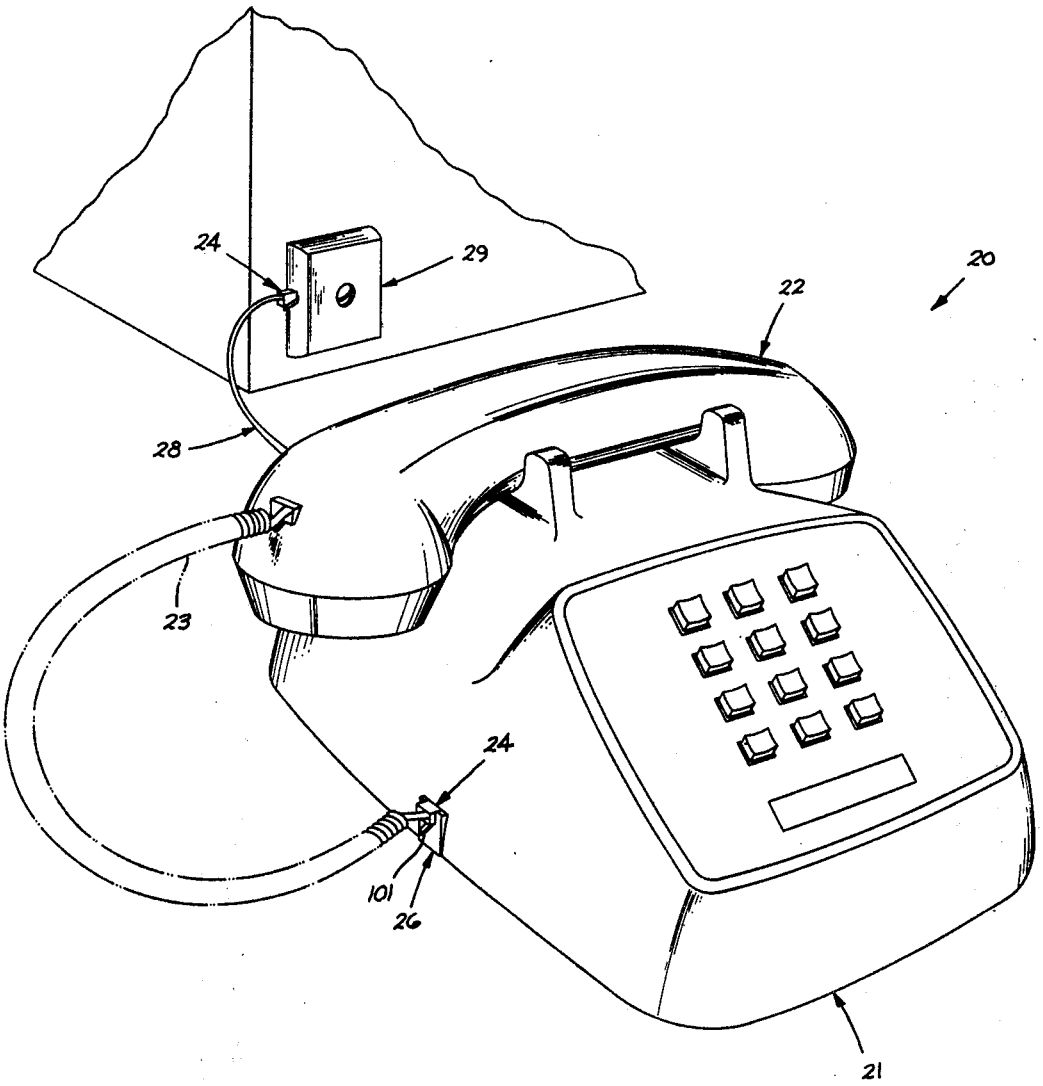
FIG. 1 is a perspective view showing plugs which embody the principles of this invention inserted into a handset and a base portion of a telephone set and into a wall terminal block.

Referring now to FIG. 1, there is shown a telephone, designated generally by the numeral 20, which includes a base portion, designated generally by the numeral 21, and a handset portion, designated generally by the numeral 22. A retractile cord, designated generally by the numeral 23, interconnects the base portion 21 and the handset portion 22.

Each end of the retractile cord 23 is provided with a plug, designated generally by the numeral 24, designed to be inserted into a jack 26. One of the plugs 24—24 is inserted into one of the jacks 26—26 assembled to handset portion 22 and the other plug of the retractile cord 23 is inserted into a jack in the base 21 of the telephone 20. The plug 24 has facilities for establishing electrical connections between the cord 23 and internal contacting components 27—27 of the telephone 20 (see FIG. 13). Ones of the plugs 24—24 are also assembled to each end of a line cord, designated generally by the numeral 28 (see FIG. 1), for connecting the line cord to jacks 26—26 in the telephone base 21 and in a wall terminal block 29.

Figure 5:
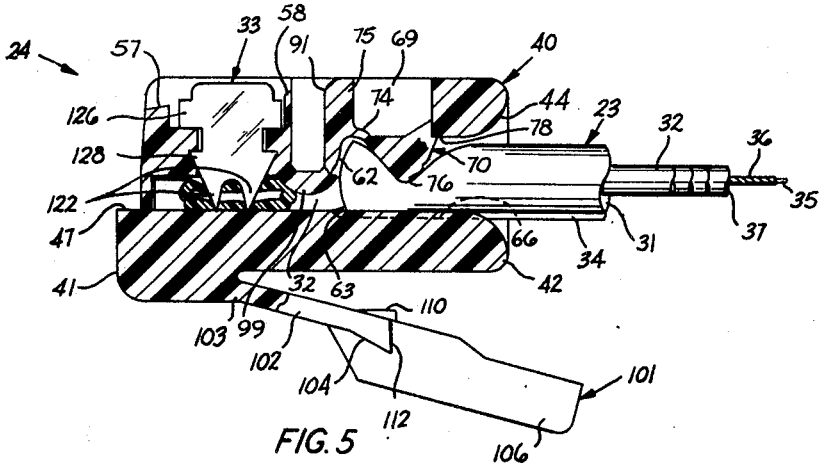
FIG. 5 is an elevational view partially in section subsequent to the assembly of the cord and the plug showing the jacket strain relief member of the plug after having been moved into engagement with the jacket of the cord to provide strain relief for the cord and a portion of the housing having been reformed into a strain-relief member in engagement with the conductors and also showing the terminals inserted.

Referring now to FIG. 5, a more detailed view of the structure of the retractile cord 23 can be seen. The retractile cord 23 includes a jacket 31 which covers a plurality of insulated conductors 32—32 and which has a ridge 34 formed longitudinally thereof. A free end portion of each of the conductor 32—32 is designed to be connected to an associated one of a plurality of terminals, designated generally by the numerals 33—33. Each of the conductors 32—32 is constructed of a nylon core 35 having a tinsel ribbon 36 wrapped helically thereabout. The tinsel ribbon 36 has an insulation covering 37 extrusion tubed thereabout (see U.S. Pat. No. 3,553,042). The outside nominal diameter of the individual insulated conductors 32—32 is approximately 0.040 inch.

Miniature plugs constructed in accordance with the present invention permit the expeditious connection of cord ends to the completed dielectric portion of the plugs rather than to a dielectric subassembly which must then be assembled to at least one other subassembly. This avoids having to maintain the cord 23 in a predetermined position in the subassembly while assembling the dielectric portion of the plug.

DIELECTRIC PORTION

Figure 2:
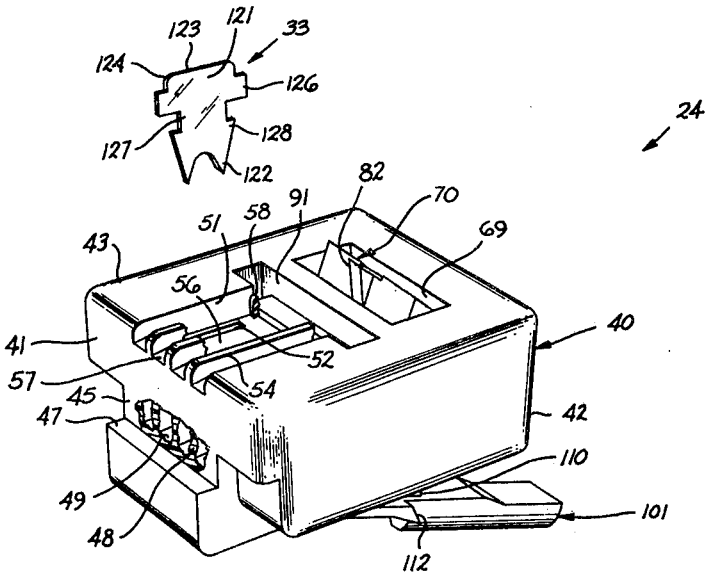
FIG. 2 is a perspective view of one of the plugs prior to assembly of a cord and terminals therewith for purposes of clarity and further showing an internally moveable jacket strain relief member of the plug prior to movement thereof.
Figure 3:
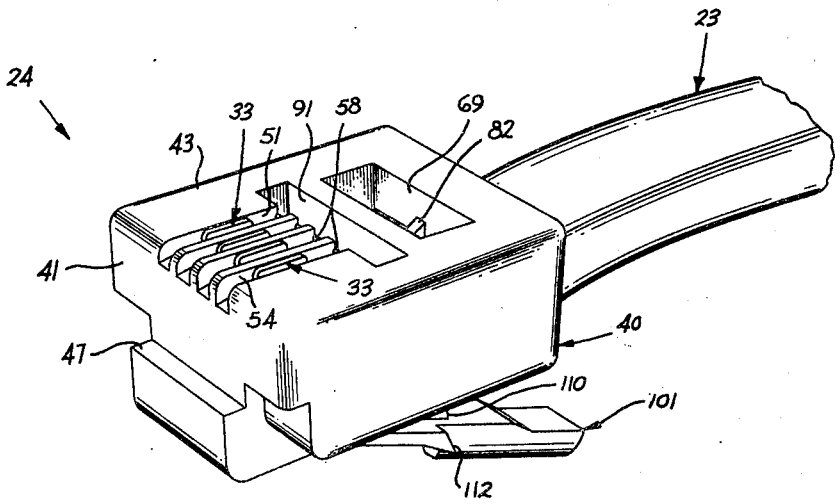
FIG. 3 is a perspective view of the plug shown in FIG. 2 with terminals and the cord end inserted into the plug and with the jacket strain relief member having been moved into engagement with the cord which has been inserted into the plug.
Figure 4:
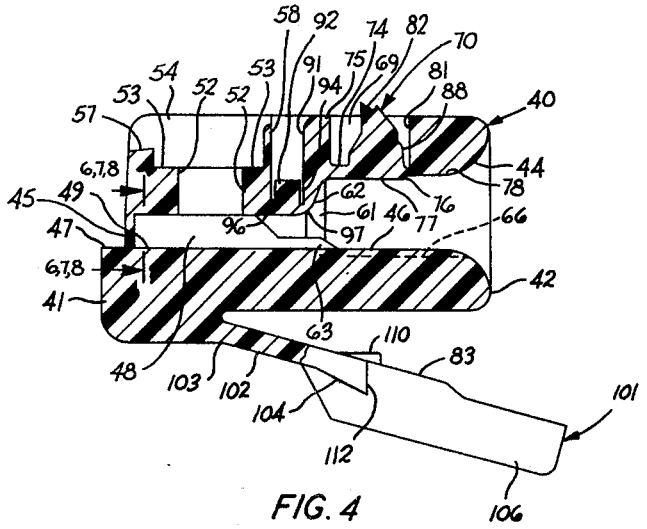
FIG. 4 is an elevational view of a housing of the plug partially in section prior to the assembly of the cord and terminals therewith.

The detailed construction of a plug 24 is shown in FIGS. 2 and 4. A rigid, dielectric unipartite housing, designated generally by the numeral 40, is designed to be easily molded by using conventional injection molding techniques. The housing 40 may be constructed of materials such as, for example, polycarbonate, polyamide, polystyrene, polyterephthalate, or polyester elastomers or related polymers such as ABS resin or glass-filled mixtures thereof. The rigid, dielectric housing 40 has a free end 41, a cord-input end 42, and a terminal-receiving side 43 (see also FIG. 3).

It may be observed from FIGS. 4 and 5 that the housing 40 is formed with a cord input aperture 44 which circumscribes substantially the portion of the jacket 31 of the cord 23 extending therethrough. As may be appreciated from the drawing, the housing 40 is constructed in one-piece with the cord input aperture 44 formed entirely therewithin. The aperture 44 has a flared entrance which prevents sharp bends in the cord 23 about an otherwise sharp edge during use of the telephone 20 by the subscriber. This advantageously increases the life of the cord 23. The flared entrance also facilitates insertion of a leading end of the cord 23.

The cord input aperture 44 opens to a cavity 46 (see FIG. 4) which terminates adjacent a ledge 47 at the free end 41 of the base of the housing 40. The cavity 46 substantially encloses the entire end section of the cord which is inserted into the aperture 44 and is completely formed as molded. No further securing together of parts such as by bonding or moving hinged parts with subsequent bonding together is required to form the cavity 46.

The formation of a one-piece housing 40 with the surfaces defining the cavity 46 substantially enclosing the entire end portion of the cord 23 facilitates holding the cord while other operations are performed by automated equipment. In prior art connectors, the cord 23 is generally positioned in a portion of a conductor-access opening formed in a base and then a lid bonded to the base. This, of course, will not suffice to hold the cord 23 in the base during assembly without additional steps and equipment. Moreover, higher costs are involved in consistently obtaining reliable bonds between the cover and the base.

In a preferred embodiment, the housing 40 is constructed to prevent a dielectric breakdown between adjacent ones of the conductors 32—32. Such a breakdown may occur, for example, because of the ingress of moisture of other corrosive contaminants and because of shortened dielectric paths between adjacent ones of the conductors 32—32. These provisions include molding of the housing 40 such that the cavity 46 is closed off from the free end 41 of the housing 40 by a wall 45 (see FIG. 4).

Figure 6:
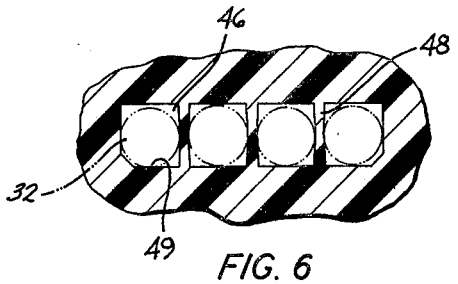
FIG. 6 is an end view in section taken along line 6—6 of FIG. 4 and showing a preferred embodiment of conductor-receiving troughs.

As can best be seen in FIGS. 2 and 6, the cavity 46 is formed with a plurality of longitudinally extending partitions 48—48 which are molded with the dielectric housing 40. The partitions 48—48 extend the full height of cavity 46 to form a plurality of flat-bottom conductor-receiving troughs or ducts 49—49 therebetween. The conductor-receiving troughs 49—49 are designed to received associated ones of the conductors 32—32. The full-cavity height of the partitions 48—48 maintains effectively the conductors 32—32 in separate compartments, each approximately 0.038 inch wide and 0.042 inch high. Although the outside diameter of each conductor 32 is about 0.040 inch, the conductor because of the tubed insulation 37 and tinsel conductor 36 and air space therebetween may be reconfigured with ease to be received in the troughs 49 of the preferred embodiment. Each of the troughs 49—49 is dimensioned so that the conductor 32 therein cannot move laterally. This is necessary to insure that during the insertion of the terminals 33—33, the terminals remain aligned with the conductors 32—32 to make electrical engagement therewith.

The troughs 49—49 are constructed advantageously with the flat-bottom portions (see FIG. 6). These provide a bearing surface against which the terminals 33—33 are driven and provide substantial support for the associated conductors 32—32 to avoid undue lateral displacement thereof during terminal insertion.

Figure 7:
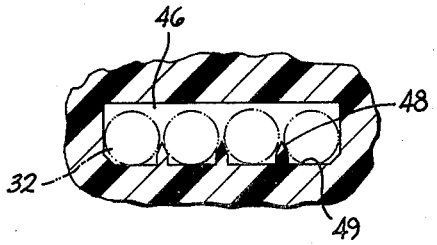

In an alternate embodiment, the partitions 48—48 are modified to the configuration shown in FIG. 7 and are on approximately 0.040 inch centers. The configuration shown in FIG. 7 or in the alternative in FIG. 8 increases the dielectric path between conductors over that shown in U.S. Pat. No. 3,860,316 and reduces substantially the probability of breakdown.

Figure 9:
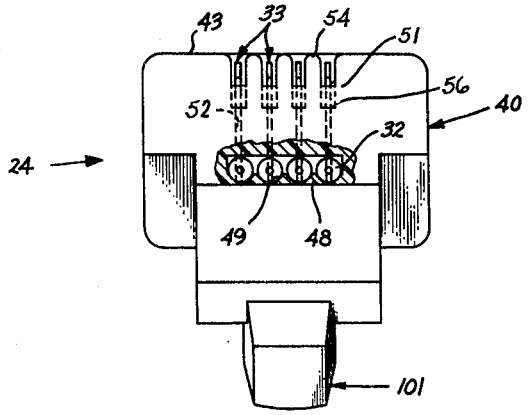
FIG. 9 is a front end view of the plug housing shown in FIG. 4 and 6 with a portion of an end wall broken away to show a still further embodiment of the conductor-receiving troughs.

In a still further alternative embodiment, the partitions 48—48 are in the form of toothed ridges (see FIG. 9) with the plurality of flat-bottom, conductor-receiving troughs 49—49 formed therebetween on 0.040 inch centers. Each of the flat-bottom portions of the troughs 49—49 is approximately 0.018 inch wide. The troughs 49—49 may extend into the wall 45 to receive the ends of the conductors 32—32 to avoid inadvertent crossover of the conductors over the partitions during insertion.

Figure 10:
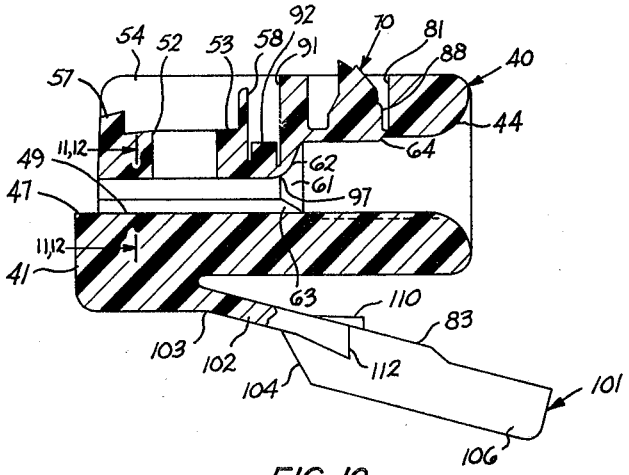
FIG. 10 is an elevational view of an alternative embodiment of the plug housing.

In the alternative, the housing 40 may be constructed as shown in FIG. 10 with the cavity 46 and the ends of the troughs 49—49 shown in FIGS. 6, 7, 8 or 9 opening to the free end ledge 47.

In the embodiment shown in FIG. 10, the bottoms of the troughs 49—49 are substantially coplanar with the top surface of the ledge 47 at the free end 41. This facilitates the use of the ledge 47 at the free end 41 as an anvil for conductor cut-off during assembly of the plug 24 to the cord 23. Since the construction of the housing 40 with the end wall 45 precludes use of the free end 41 as an anvil to cut off the conductors 32—32, the cord end must be stripped with some precision insofar as length of the jacket removed.

As can best be seen in FIG. 2, the housing 40 is formed with a well 51 having a plurality of spaced parallel terminal-receiving openings 52—52 opening thereto. The openings 52—52 are in the form of slots and are aligned on a one-to-one basis with associated ones of the conductor-receiving troughs 49—49. Each of the terminal-receiving slots 52—52 is parallel to and communicates with an associated one of the conductor-receiving troughs 49—49. Each of the slots 52—52 is of a length slightly less than the associated length of that portion of the terminal 33 which is to be received therein. The shortening of the slots 52—52 from the overall length of the well 51 forms abutments 53—53 (see FIG. 4, for example).

Figure 8:
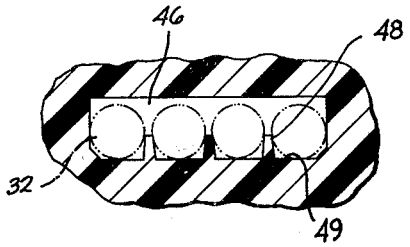
FIGS. 7 and 8 are end views in section taken along lines 7—7 and 8—8, respectively, of FIG. 4 and showing alternate embodiments of the conductor-receiving troughs.

The construction of the partitions 48—48 as shown in FIGS. 6, 7 or 8 causes the center lines of the troughs 49—49 formed therebetween to be misaligned alightly with the center lines of the terminal-receiving openings. Hence, the longitudinal axes of the conductors 32—32 received within the troughs 49—49 will not be aligned precisely with the terminal-receiving blades 33—33. For example, the longitudinal center line of each of the troughs 49—49 adjacent the longitudinal center line of the housing 40 is approximately 0.002 inch out of alignment with the associated terminal blades 33—33 which are on 0.040 inch spacing. The outermost blades 33—33 may be misaligned approximately 0.006 inch from their associated conductors 32—32. This does not affect adversely the electrical engagement of the terminals 33—33 with the tinsel ribbon 36 which may be effected slightly off center of the conductor as well as along the center line because of the helical wrapping of the tinsel conductor 36 about the core 35.

The dielectric housing 40 is also formed with a plurality of fins 54—54 (see FIGS. 2, 3 and 9) upstanding from a bottom surface 56 of the well 51 to which the terminal-receiving slots 52—52 open and are spaced on centers of approximately 0.040 inch. The fins 54—54 are aligned between adjacent associated ones of the terminal-receiving slots 52—52 with the external contacting components 27—27 of the jack 26 received between the associated fins and thereby guided into engagement with portions of the terminals 33—33 (see FIG. 13).

Figure 13:
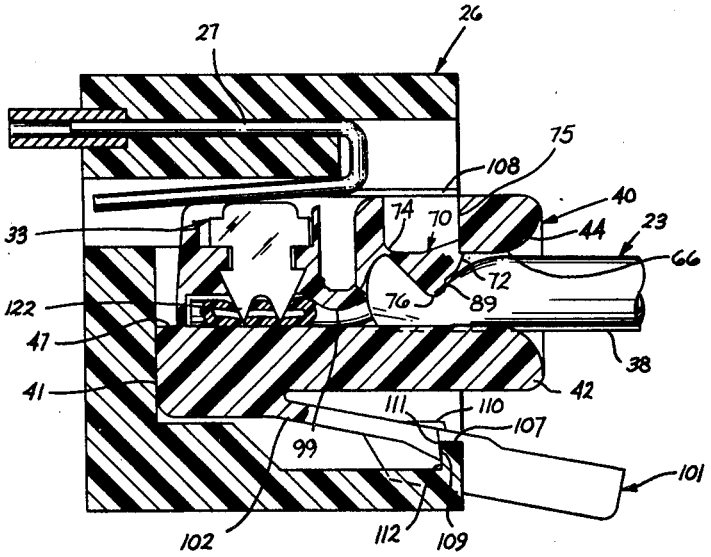
FIG. 13 is an elevational view partially in section and showing the plug inserted into a jack in a telephone set.

Prior to the insertion of the plug 24 into the jack 26, free end portions of the external contacting portions 27—27 extend at an angle in the range of 30° to 45° to the horizontal as views in FIG. 13. Advantageously, upon insertion of the plug 24 into the jack 26, the initial deflection of the free end portions of the contacting portions 27—27 is accomplished by their engagement with associated ones of a plurality of wire-lifters 57—57 (see FIGS. 2 and 4) formed integrally with the housing 40.

The burden of initially deflecting the contacting portions 27—27 is borne by dielectric material of the housing thereby avoiding abrasion of the surfaces of the contacting portions with the associated terminals. This extends the life of the terminals 33—33 and preserves the integrity of the contacting surfaces for engagement in the operative position shown in FIG. 13.

Finally, the housing 40 has a stiffener 58 (see FIG. 3) spanning between and connected integrally with side walls of the well 51 oriented toward the cord-input end 42 of the housing 40. The stiffener 58 strengthens the plug 24 to resist undue bending during the actuation of conductor strain-relief facilities described hereinafter.

As can best be seen in FIG. 4, the portion of the cavity 46 adjacent the cord-input end 42 communicates with the main portions of the conductor-receiving troughs 49—49 through a tapered transition section 61 having a shoulder 62. The partitions 48—48 are constructed to extend along a sloping face 63 of the tapered transition section 61.

In assembling the plug 24 to the cord 23, a portion of the cord jacket 31 of the cord is stripped to expose a predetermined length of each of the insulated conductors 32—32. The cord 23 is inserted into the input aperture 44 and into the cavity 46 until the conductors 32—32 are moved along associated ones of the walls which define the conductor-receiving troughs 49—49 extending down the sloping face 63.

The portions of the partitions extending down the sloping face 63 assist in separating and guiding the conductors 32—32 into the main portions of the associated ones of the troughs 49—49. In order to accomplish the separation of the conductors 32—32, the end portions of the partitions 48—48 facing into this cavity 46 are feathered to present dividing edges to the inserted cord 23.

As the conductors 32—32 are moved laterally off the sides of the face 63, the jacketed portion of the cord 23 is being moved into the cavity 46. When the cord 23 has been advanced such that the conductors 32—32 are received in the troughs 49—49, the leading end of the jacket 31 is in engagement with the shoulder 62 (see FIG. 5).

Also, as can be seen in FIG. 4, the walls of the cavity 46 are formed to include a groove 66 longitudinally thereof. The groove 66 is designed to mate with cords having the ridge 34 formed externally of the jacket to insure that the cord 23 is inserted properly into the plug 24 such that the conductors 32—32 are properly oriented with respect to the jack 26 when the plug is inserted thereinto.

The unipartite housing 40 is constructed advantageously with facilities for providing strain relief for the jacket and for the individual conductors 32—32. This permits the use of a one-piece molded plug rather than two parts assembled to the cord 23. As can best be seen in FIGS. 2 and 11, the housing 40 is constructed with an opening or well 69 which is adjacent the cavity 46. The well 69 has disposed therein a jacket-anchoring member 70, which includes internally facing surfaces 71 and 72 intersecting along an edge 73. The anchoring member 70 is connected to the housing 40 through a plastic hinge 74 oriented toward the free end 41 of the housing 40 and extending from a wall 75, and by a severable web or frangible portion 76 oriented toward the cord-input end 42. Referring to FIG. 2, it is seen that the member 70 extends generally across the width of the opening 69. The anchoring member 70 also has a surface 77 which protrudes slightly, e.g., 0.005inch, into the cavity 46 beyond an adjacent inwardly facing surface 78 of the remainder of the housing adjacent the cord-input aperture 44.

Figure 11:
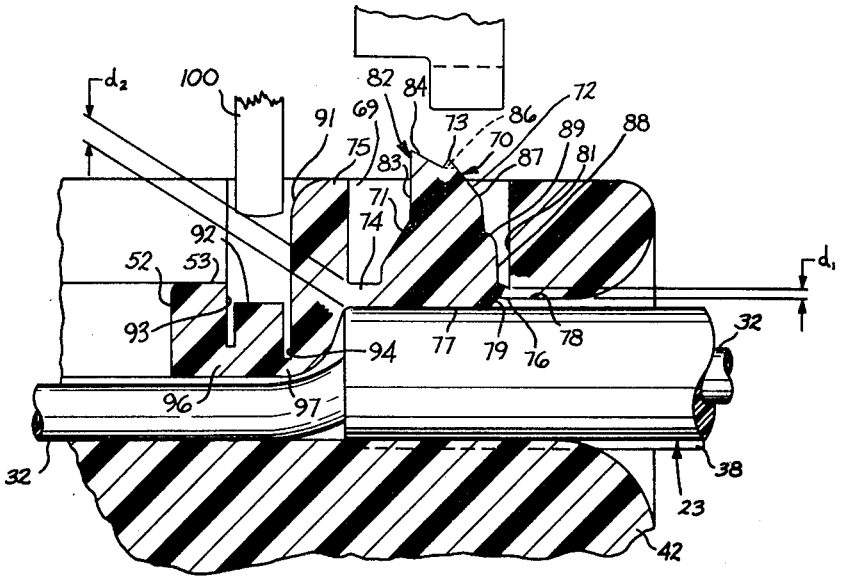
FIGS. 11 and 12 are enlarged detail views in elevation showing the jacket and conductor-strain-relief facilities prior to and subsequent to the operation thereof.

The web 76 is connected to the surface 78 by a step or connecting surface 79 (see FIG. 11). The web 76 supports the anchoring member 70 in its initial position to permit insertion at a cord end into the cavity 46. But for this, the member 70 could descend into the cavity either under its own weight or by forces imparted to the housing 40 during handling thereby obstructing entrance of the cord end.

As can best be seen in FIG. 11, the web 76 is constructed such that the dimension $d_1$, adjacent a wall 81, is substantially less than the dimension $d_2$ of the hinge 74 adjacent the wall 75. Moreover, while the inwardly facing surface of the web 76 is parallel to the surface 78, the outwardly facing surface of the web is sloping so that the thickness of the web adjacent the main portion of the anchoring member 70 exceeds $d_1$. This controls the separation of the member 70 from the housing 40 to be adjacent the cord-input end 42 so that the anchoring member may be moved pivotally about the intended hinge 74 to engage the cord jacket 31. Further, this insures that the separation occurs advantageously adjacent the wall 81 thereby avoiding any unwanted burrs that could impede the movement of the member to the actuated position.

When the anchoring member 70 is moved to an actuated position (see FIG. 12), the web 76 together with the adjacent portion of the step 79 create a rounded trailing edge of the hinged member 70 to be formed and curled counter-clockwise, advantageously into engagement with the contour of the cord 23. Since this is the portion that most firmly engages the cord, it is most advantageous that the burrs or edges are not opposed to the direction of the pulling forces anticipated during use thereby avoiding tearing the material comprising the jacket 31.

The structural arrangement is not possible if the hinge 74 were oriented toward the cord-input end 42. To design a connecting surface 79 into that arrangement would create, undesirably, an undercut which cannot be molded. In the inventive design, the major core pin (not shown) need only be stepped and can easily be removed.

The anchoring member 70 is molded to include a wedge-shaped stop 82 extending from and centrally disposed of the surface 71 (see FIGS. 2 and 11) and includes two surfaces 83 and 84. The stop 82 which is to form an important part of the jacket latching arrangement is formed on the surface 71 adjacent the edge 73; however, the edge 73 of the anchoring member 70 is discontinuous and is chamfered along a portion thereof in alignment with the stop 82 to form a bevel 86 (see FIG. 11). It should be understood that the plugs 24—24 used to terminate large numbers of conductors may require lengthened anchoring members 70—70 and desirably a plurality of stops 82—82.

The general surface 72 of the anchoring member 70 is formed with two surfaces 87 and 88 (see FIGS. 11 and 12) connected by a step 89. The configuration assumes importance in the anchoring of the cord 23.

The forces applied to the anchoring member 70, and pivotal movement thereof, causes the portion thereof adjacent the intersecting externally facing surfaces 71 and 72 to be compressed as it is moved along the side of the wall 81 of the opening 69. As the intersecting edge 73 of the surfaces 71 and 72 passes beyond the surface 78, a portion of the surface 71 snap locks under a lip formed by a portion of the surface 78 (see FIGS. 5 and 12). The extent of the engagement of the anchoring member 70 with the surface 78 is a minimum of about 0.008 inch. Although there is some compression of the anchoring member 70 during this movement, once it is moved out of engagement with the side wall 81 of the opening 69, its elastic memory properties facilitate spring-back to generally its initial configuration with an accompanying catching under the lip surface 78.

When the anchoring member 70 is moved to the actuated position, the surface 84 of the stop 82 engages the wall 81 approximately at the time portions of the surfaces 71 adjacent the edge 78 snap-lock under the surface 78. The surface 84 of the stop 82 and the portion of the surface 71 cooperate in their engagement with the wall 81 and the surface 78 to maintain the anchoring member 70 in continuing locked engagement with the cord 23 and the housing 40.

This arrangement enhances the ability of the plug 24 to provide strain relief for the jacket 31 and which surprisingly continues to be effective with use of the cord 23. The stop 82 is maintained in locking engagement with the wall 81 when retrograde forces are applied to the cord 23 by the customer.

Figure 12:
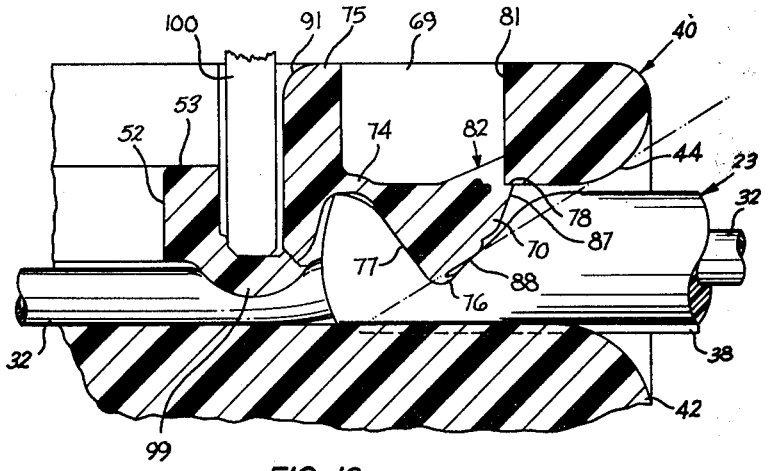

The configuration of the surface 72 is such that when the anchoring member is moved into the actuated position, the surface 88 is aligned with a tangent to a portion of the cord-input aperture 44 (see FIG. 12). This provides somewhat of a continuous support for the cord 23 when the cord is flexed toward the plug surface 43 and hence tends to relieve excess stresses in the vicinity of the web 76.

The unitary dielectric housing 40 is also formed with facilities to provide strain relief for the conductors 32—32. An opening 91 (see FIGS. 2, 4 and 11) extends transversely across a portion of the housing 40. A conductor anchoring member in the form of a restaining bar 92 which is constructed of a dielectric material spans opening 91. The conductor restraining bar 92 is spaced from the end walls of the opening 91. A portion of the conductor restraining bar 92 is spaced from the main portion of the housing 40 by slots 93 and 94. Another portion of the restraining bar 92 is integral with the walls of the opening 81 through connecting portions 96 and 97.

The relative depths of the slots 93 and 94 are important to the effectiveness of the bar 92 as a conductor strain-relief facility. The bar 92 is formed integrally with the housing such that the slot 94 is of substantially greater depth than that of the slot 93. This arrangement will cause the bar 92, which cannot because of space limitations be constructed identical to the anchoring member 70, to in fact become reformed under application of forces into a configuration similar to that of the pivotally actuated anchoring member 70.

The restraining bar 92 is reformed or upset within the opening 91 to provide a generally headed strain relief elements 99 (see FIG. 12) which is in engagement with ones of the individual conductors 32—32. Forces are applied to the restraining bar 92 through a specially designed tool 100 (see FIG. 12). The bar 92 fractures through the portion 97 oriented toward the cord-input end 42 and effectively locks the element in engagement with the conductors 32—32.

The use of the one-piece or unipartite dielectric housing 40 affords certain advantages. It permits an operator to simply insert a jacketed cord 23. Heretofore, separate or hinged portions (see application, Ser. No. 311,575 filed Dec. 4, 1972 in the name of E. C. Hardesty, now U.S. Pat. No. 3,835,445) are mated together to secure the cord jacket and the conductors 32—32 within the assembled dielectric body. Finally, the terminals 33—33 are inserted into the assembled dielectric body.

In using a connecting device embodying the principles of this invention, there is no required bonding of mating portions with accompanying problems of alignment and quality of the bond. Moreover, the housing 40 has provisions molded therewith for securing the cord 23 to the plug and for alleviating strain relief on the cord jacket 31 and the conductors 32—32 during customer use. The jacket-anchoring member 70 and the conductor restraining bar 92 not only secure the plug 24 to the cord 23 but also provide strain relief for the jacket and the conductors, respectively.

In this way, the terminals 33—33 function only to make electrical contact with the conductors 32—32 and are not required disadvantageously to retain the conductors and resist the forces imparted to the conductors or the cord during customer use. The forces on th conductors 32—32 occur notwithstanding the anchoring of the jacket 31 with the member 70. While the pressure on the jacket 31 may prevent the insulation 37 of the conductors 32—32 from moving relative to the jacket, the pressure is not sufficient to prevent the nylon core 35 and ribbon 36 from moving relative to the insulation thereof during customer use. This occurs because the insulation 37 is tubed over the core 35 and tinsel ribbon 36 wrapped about the core. Forces applied to the cord 23 by the subscriber tend to cause the core 35 and ribbon 36 to move slideably within the insulation 37. This movement, if unchecked, could cause the tinsel ribbon to be torn at the engagement thereof with portions of the terminals 33—33. The configuration of the restraining bar 92 and the different depth slots 93 and 94 results in the formation of a restraining member of surprisingly excellent performance characteristics.

The molding of the housing 40 with the ability to be able to precisely confine the conductors 32—32 in the troughs 49—49 is especially important in order to insure that the terminals 33—33 penetrate the insulated conductors 32—32. The terminals 33 must be inserted with sufficiently high forces imparted thereto to penetrate the insulation. If the conductors 32—32 were free to move laterally of the plug, the terminals 33—33 may very well slice into the insulation on either side of the conductive elements and fail to establish electrical engagement therewith.

Formed integrally with dielectric housing 40 is a resilient locking tab, designated generally by numeral 101 (see FIGS. 2 and 13) which is approximately 0.040 inch thick, 0.200 inch wide, and 0.500 inch long. The locking tab 101 is molded so that its longitudinal axis is oriented at an angle approximately 15 degrees with respect to the plane of the terminal-inserting side 43 and with a generally flat portion 102 connected by a plastic hinge 103 to the free end 41 of the housing 40. The portion 102 is stepped to form wings 104—104 adjacent a subscriber-contact portion 106.

The hinge 103 is constructed to be approximately 0.025 inch in thickness. This directs essentially all the bending of the tab 101 to occur at the hinge 103.

Figure 14:
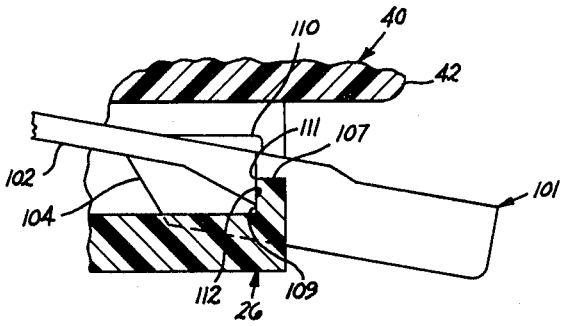
FIG. 14 is an enlarged detail view of a portion of latching facilities of the plug in engagement with surfaces of a jack in the telephone set.

The combined height of the thickness of the locking tab 101 and resiliency of the locking tab permits the insertion of the plug 24 into the jack 26 between opposing surfaces 107 and 108 (see FIG. 13). The tab 101 can be deflected inwardly of the dielectric housing 40 to become substantially coplanar with the under-surface of the housing 40 and be moved slideably in engagement with the surface 107 which forms an entrance ledge (see FIG. 14). The locking tab 101 also has a stop 110 formed on the inwardly facing side of the flat portion 102. The stop 102 prevents an undue amount of deflection of the tab 101 into engagement with the under surface of the plug 24 which could permanently deform the hinge 103.

After being released, the locking tab resumes essentially its original molded shape and orientation. Proper resilience to provide desired flexing properties can be incorporated into the locking tab 101 when it is molded from polycarbonate or other appropriate materials with the aforementioned dimensions. Return of the tab 101 to its originally molded shape causes the free end of the tab to be urged downwardly into locking engagement with surfaces of the jack 26 (see FIGS. 13 and 14) in the handset 22 and base 21. A wall 109 and the ledge surface 107 cooperate to form an edge 111 which engages with a surface 112 of the locking tab 101. This holds the plug 24 to the jack 26 in the handset 22 and insures integrity of the connection during customer use.

Terminals

As can best be seen in FIG. 2, each one of the terminals 33—33 is made from an electrically conductive resilient material such as Phosphor bronze and has a flat conductive portion 121 with at least one contact or insulation-piercing tang 122 protruding therefrom. The tangs 122—122 provide electrical connection between the conductive portion of the conductor 32—32 and the associated ones of the terminals 33—33.

Each of the terminals 33—13 also has an edge surface 123 having curved crowns 124—124 of predetermined radii. The crown 124 nearest the free end 41 of the housing 40 functions to complete the connection between the associated external-contacting component 27 illustrated in FIG. 13, and positioned in the telephone jack 26.

Provisions are also made for seating properly the terminals 33—33 within the associated terminal-receiving slots 52—52. Each of the terminals 33—33 is formed with shoulders 126—126 having necked-down portions 127—127 that terminate in barbs 128—128. As was indicated hereinbefore, the overall length of the terminal 33 out-to-out of the barbs 128—128 is greater than that of the length of the terminal-receiving slot 52. When the terminal 33 is inserted into the associated terminal-receiving slot 52, the barbs 128—128 penetrate the dielectric material which defines the slot to anchor the terminal (see FIG. 5).

The extent to which the terminal 33 is inserted into the associated slot 52 is determined by the operation of an apparatus (not shown) used to insert the terminals. Generally, that apparatus is controlled to insert the terminals 33—33 within the associated ones of the terminal-receiving slots 52—52 such that the shoulders 126—126 are spaced above the abutments 53—53.

The extent to which the terminal 33 is inserted into the associated terminal-receiving slot 52 is controlled to also insure that adequate electrical engagement is effected between the terminal tangs 122—122 and the conductors 32—32. If the depth of insertion is lacking, the tangs 122—122 may not engage one or both generally diametrically opposed portions of the helical tinsel ribbon 36. On the other hand, if the depth of insertion is too great, the shoulders 126—126 could rupture the abutments 53—53. It is important that the tangs 122—122 engage the top or closest portion of the tinsel ribbon 36, be moved through the core 35 through the bottom portion of the helically wrapped tinsel ribbon, and into engagement with the flat bottom portions of the troughs 49—49 (see FIGS. 5 and 13).

The arrangement of the tangs 122—122 with dielectric material is further reason for the flat-bottom configuration of the troughs 49—49. If the bottoms were V-shaped, difficulties may arise in causing the tangs 122—122 to become embedded in the dielectric material.

While the terminals 33—33 have been shown in a flat or blade-like configuration, it should be obvious that they could be in the form of pins (not shown). Of course, the terminal-receiving openings 52—52 would then be molded to accommodate the pins (not shown) rather than the blade-like terminals 33—33.

Alternate Embodiment of Dielectric Portion

The principles of this invention may be used to construct a housing 40 which may accommodate an end portion of a flat cord 23 without the necessity of removing the jacket from an end portion thereof. The cavity 46 is molded without the conductor-receiving troughs 49—49 and such that a leading end portion of the cord 23 is inserted into the cavity. The cavity 46 is constructed to communicate with the terminal-receiving slots 52—52 and may or may not open to the free end 41 of the housing 40. After the end portion of the cord 23 is inserted into the cavity, the terminals 33—33 are driven into the slots 92—92 into engagement with the conductors. Since the cord 23 is flat, and assuming that the cord is inserted properly into the cavity 46, the conductors are aligned properly with the terminals 33—33.

It is to be understood that the above described arrangements are simply illustrative of the invention. Other arrangements may be devised by those skilled in the art which will embody the principles of the invention and fall within the spirit and scope thereof.

What is claimed is:

1. An electrical connector for terminating a cord having a plurality of insulated conductors and for making electrical contact external to the connector, which comprises:

an unipartite dielectric housing having one free end with internal surfaces of the housing defining a cavity that opens to the other end of the housing for receiving and substantially enclosing an end portion of a cord, with at least one portion of the housing adjacent the cavity being disposed in an initial position in a well and connected pivotally to the remainder of the housing toward the free end thereof, the pivotally connected portion having two intersecting externally facing surfaces, one of which has a stop formed thereon, the pivotally connected portion capable of being moved from the initial position to an actuated position at least partially into the cavity to clamp portions of the cord, and with a portion of the one externally facing surface of the pivotally moveable portion engaging an inwardly facing surface of the cavity of the remainder of the housing adjacent the cord-input end of the housing and the stop engaging a wall of the well adjacent the inwardly facing surface, the dual engagement of the one surface and of the stop with portions of the housing being effective to maintain the pivotally moveable portion in locked engagement with the cord during the application of retrograde forces to the cord; and a plurality of electrically conductive terminals positioned within the housing and extending between the cavity where the terminals pierce the insulation of and make electrical engagement with associated conductors of the cord and an external surface of the housing where the terminals make electrical contact external to the connector.

2. The electrical connector of claim 1, wherein the free end of the housing is formed with an end wall which separates the cavity from the free end of the housing.

3. The electrical connector of claim 1, wherein the pivotally moveable portion of the housing includes an anchoring member connected at one end through a hinged portion oriented toward the free end of the housing and the other end of the anchoring member oriented toward the cord-input end of the housing is connected by a frangible portion severably to the remainder of the housing so that the application of forces for moving the anchoring member form the initial to the actuated position causes the other end of the anchoring member to be separated from the remainder of the housing.

4. The electrical connector of claim 3, wherein the housing also includes a plurality of terminal-receiving openings communicating with the cavity and the exterior of the connector and each of the terminals includes:

a first contact portion extending into the cavity for piercing the insulation of and making electrical engagement with an associated conductor of the cord, and a second contact portion positioned within the associated terminal-receiving opening for making electrical contact external to the connector.

5. The electrical connector of claim 4, wherein the frangible portion includes a tapered web substantially planar with the adjacent surfaces of the portion of the remainder of the housing adjacent the cord-input end and which is connected to a surface of the moveable portion which protrudes into the cavity by a connecting surface and formed so that the application of forces causes the web to be separated from the remainder of the housing to form an elongated extension which is caused to assume a curved shape as the anchoring member is moved pivotally and together with the connecting surface to form a blunt portion which engages and clamps the cord without damaging the cord.

6. The electrical connector of claim 4, wherein the other one of the surfaces of the anchoring member which is externally facing when the anchoring member is in the initial position and which is adjacent the severable portion is formed such that a portion thereof contiguous to the severable portion is moved into engagement with the cord, further the cord-input end of the housing having a flared entrance portion such that the portion of the stepped portion is aligned with a tangent to a portion of the flared entrance when the anchoring member is in the actuated position.

7. The electrical connector of claim 4, which also includes a conductor restraining bar formed integrally with the housing and disposed within an opening in the housing which is interposed between the well and the terminal-receiving openings and which communicates with the cavity, the restraining bar separated partially from the remainder of the housing by a first slot oriented toward the free end of the housing and second slot oriented toward the cord-input end of the housing, the second slot extending substantially further from the opening to the cavity than the first, the application of forces to the bar causing the bar to be reformed and upset into the cavity into engagement with the conductors in the cavity and causing the bar to fracture from the second slot to the cavity with relative displacement of the bar along the line of fracture to lock portions of the bar adjacent the second slot in engagement with the remainder of the housing and the cord.

8. The electrical connector of claim 7, wherein the housing also includes conductor-receiving troughs formed in at least a portion of the cavity and with the plurality of terminal-receiving openings communicating with the troughs and with the exterior of the connector.

9. The electrical connector of claim 8, wherein the troughs are formed between a plurality of parallel partitions extending through a portion of the cavity from the vicinity of the free end thereof toward the cord-input end thereof and between ones of the partitions and the side walls of the cavity.

10. The electrical connector of claim 9, wherein the partitions extend from the surface of the cavity to which the terminal-receiving openings open to the opposed inwardly facing surface thereof.

11. The electrical connector of claim 9, wherein the partitions extend partially between a surface to which the terminal-receiving openings open and a surface opposite thereto.

12. A device for terminating a cord, which comprises:

an unipartite dielectric housing having one free end with internal surfaces of the housing defining a cavity that opens to the other end of the housing for receiving and substantially enclosing an end portion of a cord, with at least one portion of the housing adjacent the cavity being disposed in an initial position in a well and connected pivotally to the remainder of the housing toward the free end thereof, the pivotally connected portion having two intersecting externally facing surfaces one of which has a stop formed thereon, the pivotally connected portion capable of being moved from the initial position to an actuated position at least partially into the cavity to clamp portions of the cord, and with a portion of the one externally facing surface of the pivotally moveable portion engaging an inwardly facing surface of the cavity, the remainder of the housing adjacent the cord-input end of the housing and the stop engaging a wall of the well adjacent the inwardly facing surface, the dual engagement of the one surface and of the stop with portions of the housing being effective to maintain the pivotally moveable portion in locked engagement with the cord during the application of retrograde forces to the cord.

13. The cord terminating device of claim 12, wherein the free end of the housing is formed with an end wall which separates the cavity from the free end of the housing.

14. The cord terminating device of claim 12, wherein the moveable portion of the housing includes an anchoring member connected at one end through a hinged portion oriented toward the free end of the housing and the other end of the anchoring member oriented toward the cord-input end of the housing is connected by a frangible portion severably to the remainder of the housing so that the application of forces for moving the anchoring member from the initial to the actuated position causes the other end of the anchoring member to be separated from the remainder of the housing.

15. The cord terminating device of claim 14, wherein the anchoring member is connected severably to the housing through a tapered web substantially planar with the adjacent surface of the portion of the remiander of the housing adjacent the cord-input end and which is connected to a surface of the moveable portion which protrudes into the cavity by a connecting surface and formed so that the application of forces causes the web to be separated from the remainder of the housing to form an elongated extension which is caused to assume a curved shape as the anchoring member is moved pivotally and together with the connecting surface to form a blunt portion which engages and clamps the cord without damaging the cord.

16. The cord terminating device of claim 15, which also includes a restraining bar formed integrally with the housing and disposed within an opening the housing which is interposed between the well and the terminal-receiving openings and which communicates with the cavity, the restraining bar separated partially from the remainder of the housing by a first slot oriented toward the free end of the housing and a second slot oriented toward the cord-input end of the housing, the second slot being substantially further from the opening to the cavity than the first, the application of forces to the bar causing the bar to be reformed and upset into the cavity into engagement with portions of the cord in the cavity and causing the bar to fracture from the second slot the cavity with relative displacement of the bar along the line of fracture to lock portions of the bar adjacent the second slot in engagement with the remainder of the housing and the cord.

17. The cord terminating device of claim 16, wherein the housing also includes a plurality of terminal-receiving openings communicating with the cavity and the exterior of the connector, further the housing including a plurality of conductor-receiving troughs formed in at least a portion of the cavity and with the plurality of terminal-receiving openings communicating with the troughs and with the exterior of the connector.

18. The cord terminating device of claim 17, wherein the troughs are formed between a plurality of parallel partitions extending through a portion of the cavity from the vicinity of the free end thereof toward the cord-input end thereof and between ones of the partitions and the side walls of the cavity.

19. The cord terminating device of claim 18, wherein the partitions extend from the surface of the cavity to which the terminal-receiving openings open to the opposed inwardly facing surface thereof.

20. The cord terminating device of claim 18, wherein the partitions extend partially between a surface to which the terminal-receiving openings open and a surface opposite thereto.

21. A cord for a connection to telecommunications equipment, which comprises:

a plurality of individually insulated conductors;

a plastic jacket enclosing the conductors; and a connector for terminating at least one end of the cord, which comprises:

an unipartite dielectric housing having one free end with internal surfaces of the housing defining a cavity that opens to the other end of the housing for receiving and substantially enclosing an end portion of a cord, with at least one portion of the housing adjacent the cavity being disposed in an initial position in a well and connected pivotally to the remainder of the housing toward the free end thereof, the pivotally connected portion having two intersecting externally facing surfaces, one of which has a stop formed thereon, the pivotally connected portion capable of being moved from the initial position to an actuated position at least partially into the cavity to clamp portions of the cord, and with a portion of the one externally facing surface of the pivotally moveable portion engaging an inwardly facing surface of the cavity of the remainder of the housing adjacent the cord-input end of the housing and the stop engaging a wall of the well adjacent the inwardly facing surface, the dual engagement of the one surface and of the stop with portions of the housing being effective to maintain the pivotally moveable portion in locked engagement with the cord during the application of retrograde forces to the cord; and a plurality of electrically conductive terminals positioned within the housing and extending between the cavity where the terminals pierce the insulation of and make electrical engagement with associated conductors of the cord and an external surface of the housing where the terminals make electrical contact with equipment external to the connector.

* * * * *